US012228372B2

(12) United States Patent
Rosen et al.

(10) Patent No.: US 12,228,372 B2
(45) **Date of Patent: *Feb. 18, 2025**

(54) PROTECTIVE LENS COVER ASSEMBLY

(71) Applicant: Sheltered Wings, Inc., Barneveld, WI (US)

(72) Inventors: Michael A. Rosen, Barneveld, WI (US); Robert Morell, Barneveld, WI (US); David Hamilton, Barneveld, WI (US)

(73) Assignee: Sheltered Wings, Inc., Barneveld, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/161,521

(22) Filed: Jan. 30, 2023

(65) Prior Publication Data

US 2023/0175816 A1 Jun. 8, 2023

Related U.S. Application Data

(63) Continuation of application No. 17/166,242, filed on Feb. 3, 2021, now Pat. No. 11,566,869.

(60) Provisional application No. 62/969,285, filed on Feb. 3, 2020.

(51) Int. Cl.
*F41G 1/38* (2006.01)

(52) U.S. Cl.
CPC ..... *F41G 1/383* (2013.01)

(58) Field of Classification Search
CPC ..... G02B 23/16; G02B 27/0006; F41A 35/02; F41G 1/383
USPC ..... 42/129, 143, 96
See application file for complete search history.

(56) References Cited

U.S. PATENT DOCUMENTS 2,657,465 A 11/1953 Lloyd
2,782,510 A * 2/1957 Kramm ..... G02B 23/16 42/129
3,465,446 A * 9/1969 Cox ..... F41G 1/383 42/129
3,496,642 A 2/1970 Pfahler
3,642,345 A * 2/1972 Akin, Jr ..... G02B 23/18 359/511

(Continued)

FOREIGN PATENT DOCUMENTS

DE 1861740 U 11/1962

OTHER PUBLICATIONS

NPL: https://www.amazon.com/Tango-Protective-Cover-Aimpoint-iO-004/dp/B076ZZ4L1X/ref=cm_cr_arp_d_product_top?ie=UTF8 Dec. 29, 2019.*

(Continued)

*Primary Examiner* — John Cooper
(74) *Attorney, Agent, or Firm* — Husch Blackwell LLP

(57) ABSTRACT

A protective lens cover assembly is provided. A protective lens cover assembly comprises a body, a first lens cover and a second lens cover. The first and second lens covers are connected to the body. The first lens cover has a first set of securing structures and a second set of securing structures. The second lens cover also has a first set of securing structures and a second set of securing structures. The first set of securing structures of one of the first lens cover and second lens cover is configured to engage the second set of securing structures of the other of the first lens cover and second lens cover.

13 Claims, 3 Drawing Sheets

(56) References Cited

U.S. PATENT DOCUMENTS

| | | | | | |
|---|---|---|---|---|---|
| 3,746,423 | A * | 7/1973 | Mills | G02B 23/16 | 42/129 |
| 5,003,697 | A * | 4/1991 | Hampton | F41G 1/383 | 42/129 |
| 5,150,528 | A * | 9/1992 | Shire | G02B 23/16 | 42/129 |
| 5,566,490 | A * | 10/1996 | Owen | F41G 1/383 | 42/129 |
| 6,488,381 | B2 * | 12/2002 | Morgan, III | G02B 23/14 | 359/600 |
| 7,484,856 | B1 * | 2/2009 | Newhall | F41G 1/383 | 359/511 |
| 7,647,721 | B1 * | 1/2010 | Gaber | F41G 1/065 | 42/129 |
| 7,721,480 | B2 * | 5/2010 | Campean | G02B 7/006 | 42/129 |
| 9,846,009 | B1 * | 12/2017 | McDaniels | F41G 1/383 | |
| 2012/0257885 | A1 | 10/2012 | Chang | | |
| 2021/0254931 | A1 * | 8/2021 | Rosen | F41A 35/02 | |

OTHER PUBLICATIONS

International Search Report and Written Opinion for International Application No. PCT/US2021/016308, Apr. 22, 2021, 13 pages.
International Preliminary Report on Patentability for International Application No. PCT/US2021/016308, Aug. 18, 2022, 8 pages.
Extended European Search Report issued for European Patent Application No. 21750841.5 dated Apr. 24, 2024, 10 pages.
"Combat Optics Reviews—Part 16", Mar. 19, 2011, XP093152433, https://combatopticsreviews.com/page/16/.

* cited by examiner

PROTECTIVE LENS COVER ASSEMBLY

CROSS-REFERENCE TO RELATED APPLICATIONS

This application is a continuation patent application of U.S. patent application Ser. No. 17/166,242 filed Feb. 3, 2021, which claims priority to and is a non-provisional application of U.S. Provisional Application No. 62/969,285 filed Feb. 3, 2020, which are incorporated herein by reference in their entireties.

FIELD

The disclosure relates to protective lens cover assemblies, and more particularly to protective lens cover assemblies for red dot or rifle scope sights.

BACKGROUND

Protective lens covers are important to keep dust, lint and other debris from obscuring lenses, such as on red dot or rifle scope sights. Protective lens covers must not only securely cover a lens, but also conveniently store out of the way of the lenses, the user's hands, and the user's field of view.

Many different styles of protective lens covers for red dot or rifle scope sights exist. Each secure to the red dot or rifle scope sights in a different way, and each uses a different structure/mechanism to keep the covers out of the way during use. A body glove-style protective lens cover assembly, for example, has a body, generally elastic or other similar material, which covers a substantial portion of the body of a sight and includes two covers (one for each end of the sight). The covers are connected to the body by way of a flexible tether. The covers either hang by the flexible tethers during use or may connect to one another on a side of the sight in a somewhat out of the way location. The body glove-style of protective lens cover assembly is generally low cost compared to other alternatives, but can be difficult to secure on a sight. Moreover, when removed from the lenses, the covers can create noise or intrude on a user's field of vision.

Wire cables can also be used to secure protective lens covers to sights. A wire cable is simply affixed, usually permanently, at the ends of the sight at first ends, and the second ends connect to the covers. Like the body glove-style, the covers can either hang freely when removed from the sight or be connected to one another. With the wires permanently affixed to the sight, this style of protective lens cover assembly cannot be temporarily removed if a user does not want the wire cables or covers on a sight.

Protective lens covers can also be threaded to the objective end and/or the eye piece end of a sight. The protective lens cover assembly is threaded onto the sight and the cover portion flips open. Typically, the covers contain springs which help hold the covers in the open position. However, if the sight or firearm is moved quickly, the force could be enough to overcome the spring force and the covers may move into the user's field of vision or make noise.

Finally, "bikini-style" cover assemblies include two covers connected to one another by two stretchable bands. The bands are stretched over the sight to secure the two covers over the respective lenses. Because the bands stretch, one size cover assembly can be used on many sights. However, once removed from a sight, a user must store the cover assembly somewhere, and it generally takes two hands to replace the cover assembly.

Accordingly, the need exists for a protective lens cover assembly which addresses one or more of the above deficiencies or other problems.

SUMMARY

In one embodiment, the disclosure provides a protective lens cover assembly comprising a body; a first lens cover having a first set of securing structures and a second set of securing structures; and a second lens cover having a first set of securing structures and a second set of securing structures; wherein the first lens cover and second lens cover are connected to the body, and wherein the first set of securing structures of one of the first lens cover and second lens cover is configured to engage the second set of securing structures of the other of the first lens cover and second lens cover.

In accordance with embodiments of the present disclosure, a sight is provided. The sight comprises a sight body with an objective end having a lens and an eyepiece end having a lens; and a protective lens cover assembly connected to the sight body, the assembly comprising a body; a first lens cover having a first set of securing structures and a second set of securing structures; and a second lens cover having a first set of securing structures and a second set of securing structures; wherein the first lens cover and second lens cover are connected to the body, and wherein the first set of securing structures of the first lens cover engages the objective end of the sight body, the first set of securing structures of the second lens cover engages the eyepiece end of the side body, the second set of securing structures of at least one of the first lens cover and second lens cover engages the sight body, and the second set of securing structures of the other of the first lens cover and second lens cover engages first securing structures of the at least one of the first lens cover and second lens cover.

Other embodiments will be evident from a consideration of the drawings taken together with the detailed description of the invention.

DETAILED DESCRIPTION

Figure 1:
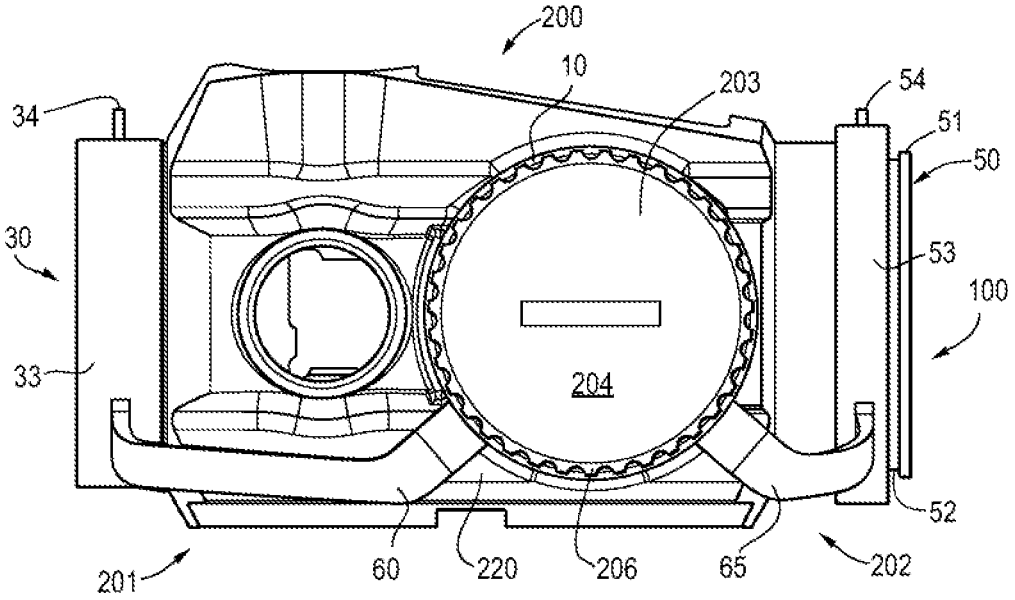
FIG. 1 is a side view of an embodiment of a protective lens cover assembly on a red dot sight in accordance with embodiments of the present disclosure.

The present disclosure relates protective lens cover assemblies, and more particularly to protective lens cover assemblies for red dot or rifle scope sights. Certain preferred and illustrative embodiments of the present disclosure are described below. The present disclosure is not limited to these embodiments.

In the embodiments shown in the Figures, the protective lens cover assembly 100 is shown in use with a red dot sight 200 having a body 220 with an objective end 201 and an eyepiece end 202 at opposite sides of the sight body 220. A battery compartment 203 having a battery compartment cap 204 is disposed between the objective end 201 and eyepiece end 202 on the sight body 220. It will be appreciated, however, that the protective lens cover assembly 100 as shown and described herein may be used on a number of different sights, including other red dot sights and rifle scope sights, and the specific size and geometry of the protective lens cover assembly 100 may be modified within reason to accommodate variations in the design of such sights.

Turning to FIG. 1 in particular, shown is a protective lens cover assembly 100 composed of two covers—an objective end cover 30 and an eyepiece end cover 50. As will be described in further detail below, each cover 30, 50 includes a first set of securing structures and a second set of securing structures. The first sets of securing structures allow the covers 30, 50 to secure to a respective end 201, 202 of the sight 200. A second set of securing structures enables the respective cover to secure to either to a portion of the sight 200 or to the other cover.

In the embodiment shown in FIG. 1, the covers 30, 50 are each connected to the assembly body 10 by flexible tethers 60, 65. The body 10 also secures the assembly 100 to the sight 200. However, in further embodiments, the covers 30, 50 may be free, e.g., not connected to the sight 200. In the particular embodiment shown, the sight-securing portion 10 is connected with the sight 200 at the battery compartment 203. Due to the position of the battery compartment 203 (e.g.), flexible tether 60 is longer than flexible tether 65.

Figure 2A:
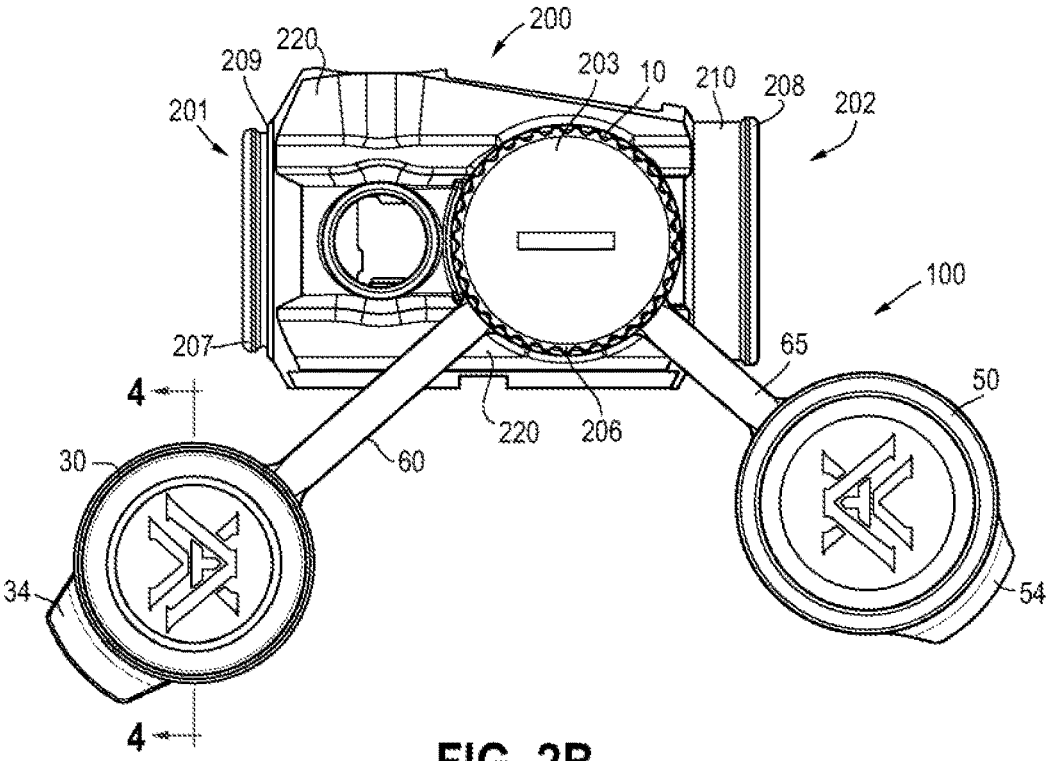
FIG. 2A is a side view of the protective lens cover assembly on the red dot sight with the lens covers removed.
Figure 2B:
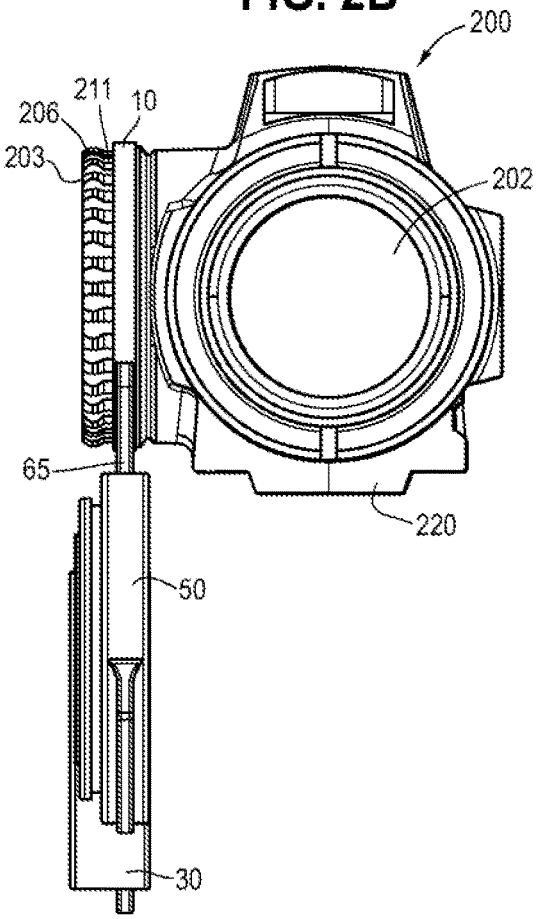
FIG. 2B is a front view of FIG. 2A.

FIGS. 2A and 2B show the covers 30, 50 removed from the objective end 201 and eyepiece end 202, respectively, as well as further details of the body 10 and the covers 30, 50. Specifically, as shown in FIG. 2B, the body 10 is generally circular to fit around a perimeter of the battery compartment 203. In an embodiment, the material of the body 10 is stretchable so that the body 10 can be stretched on to and off of the battery compartment 203; however, in further embodiments, the material of the body 10 may be less flexible and installed on the battery compartment 203 either during manufacture of the sight 200 or by removing the battery compartment cover 204 and fitting the piece in place.

Figure 3:
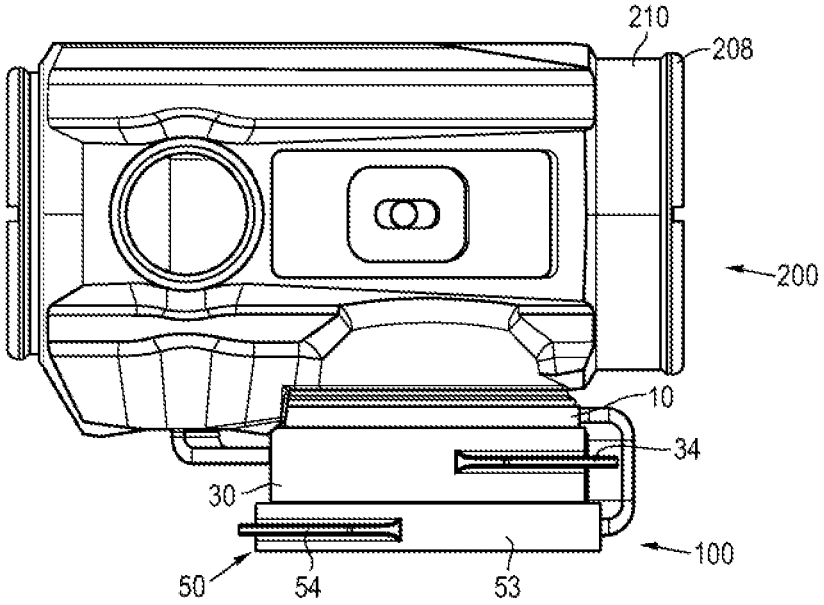
FIG. 3 is a top view of the protective lens cover assembly on the red dot sight with the lens covers secured to the battery compartment.

The covers 30, 50 themselves are designed to secure to not only the objective end 201 and eyepiece end 202, respectively, but also to each other and the battery cap 203, as shown in FIG. 3. Tabs 34, 54 on the covers 30, 50, respectively, provide additional surface area for a user to push or pull on to replace/remove covers 30, 50 on/from the ends 201, 202 of the sight 200 and secure/remove the covers 30, 50 to/from one another and/or the battery cover 204. As shown in FIG. 3, showing the covers 30, 50 secured to one another on the battery cover 204, the tabs 34, 54 are offset so a user can more readily access each of the covers 30, 50 individually.

The particular structures which permit the securing of the covers 30, 50 to the respective ends 201, 202 and each other are now discussed in detail.

Figure 4:
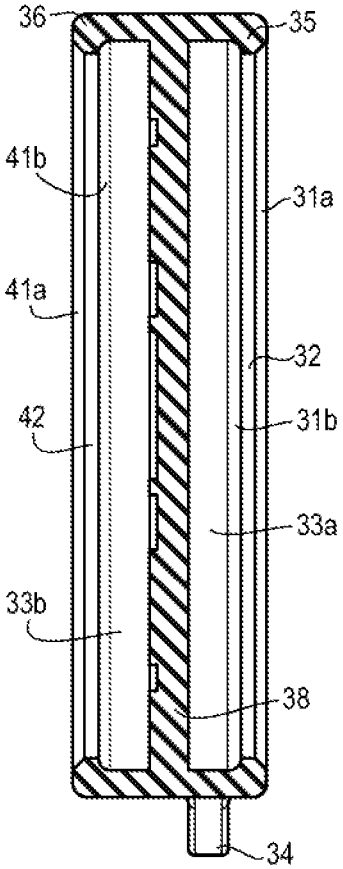
FIG. 4 is a cross-sectional view of the objective end cover taken along line 4-4 of FIG. 2A.

Turning to FIG. 4, a cross-sectional view of the objective end cover 30 is shown. The objective end cover 30 includes to sleeve portions 33*a*, 33*b* which are separated by a central wall 38 which bisects the cover 30. The sleeve 33*a* includes a first set of securing structures 35 which, in the embodiment shown, is composed of a groove 32 flanked on either side by circumferential projections 31*a*, 31*b* which extend along the entire internal circumference of the sleeve 33*a* at its outer edge.

Turning to FIGS. 2A and 3, the objective end 201 itself includes a lip 207 which projects outward from the circumference of the end 201. When the sleeve 33 is pushed over the lip 207, the first set of securing structures 35 engages or snaps over the lip 207 of the objective end 201 so as to sit in the gap 209 between the lip 207 and the sight body 220 to secure the objective end cover 30 to the objective end 201. Specifically, pushing the sleeve 33*a* onto the objective end 201, and particularly over the lip 207, results in the lip 207 being secured in the sleeve 33*a* of the cover 30 with the first set of securing structures 35 around the gap 209. The circumferential projections 31*a*, 31*b* prevent the sleeve 33*a* from disengaging the objective end 201 by simply moving the sight 200 or with inadvertent touching. Some force will be necessary to disengage the cover 30 from the objective end 201. The wall 38 prevents the cover 30 from being pushed further onto the objective end 30.

While a cross-sectional view of the eyepiece end cover 50 is not shown, it will be appreciated that the eyepiece end cover 50 has similar structures to secure to the eyepiece end 202. Specifically, the cover 50 includes a sleeve 53 with a first set of securing structures (not shown) composed of a groove flanked on either side by circumferential projections which extend along the entire internal circumference of the sleeve 53 at its outer edge. Like the objective end 201, the eyepiece end 202 also includes a lip 208 (see FIGS. 2A and 3) which projects outward from the circumference of the end 202. When the sleeve 53 is pushed over the lip 208, the first set of securing structures (not shown) engages or snaps onto the lip 208 of the eyepiece end 202 so as to sit in the gap 210 between the lip 208 and the sight body 220 to secure the cover 50 to the eyepiece end 202. Specifically, pushing the sleeve 53 onto the eyepiece end 202, and particularly over the lip 208, results in the lip 208 being secured in the sleeve 53 of the cover 50 with the first set of securing structures (not shown) around the gap 210. The circumferential projections (not shown) prevent the sleeve 53 from disengaging the eyepiece end 202 by simply moving the sight 200 or with inadvertent touching. Some force will be necessary to disengage the cover 50 from the eyepiece end 202. The inner wall of the cover 50 (not shown) prevents the cover 50 from being pushed further onto the eyepiece end 202.

As shown in FIG. 4, the objective end cover 30 also includes second sleeve portion 33*b* with a second set of securing structures 36. In the embodiment shown, the second set of securing structures 36 is identical to the first set of securing structures 35, that is, the second set of securing structures 36 is composed of a groove 42 flanked on either side by circumferential projections 41*a*, 41*b* which extend along the entire internal circumference of the sleeve 33*b* at its outer edge.

Turning again to FIGS. 1 and 2B, the battery compartment 203, and specifically the battery cap 204, includes a lip 206 which projects, in the present embodiment, radially outwardly from the battery cap 204 to form a slight recess 211 following the lip 206. In the embodiment shown, and with particular reference to FIG. 2B, the body 10 is at least partially secured around the recess 211. When the sleeve 33*b* of the cover 30 is pushed over the lip 206, the second set of securing structures 36 engages or snaps onto the lip 206 of the of the battery compartment cover 204 so as to sit in the recess 211 to secure the cover 30 to the battery compartment 203. Specifically, pushing the sleeve 33*b* onto the battery compartment 203, and particularly over the lip 206, results in the lip 206 being secured in the sleeve 33*b* of the cap 30 with the second set of securing structures 36 around the recess 211. The circumferential projections 41*a*, 41*b* prevent the sleeve 33*b* disengaging the battery compartment 203 by simply moving the sight 200 or with inadvertent touching. Some force will be necessary to disengage the cover 30 from the battery compartment 203. The wall 38 of the cap 30 prevents the cover 30 from being pushed further onto the battery compartment 203.

The eyepiece end cover 50 also has a second set of securing structures. The second set of securing structures of the eyepiece end cap 50 is specifically designed to engage the first set of securing structures of the objective end cap 30. In particular, and as shown perhaps best in FIG. 1, the eyepiece end cover 50 has a lip 51 and a gap 52, similar to the ends 201, 202 of the sight 200. To secure the eyepiece end cover 50 to the objective end cover 30 when the objective end cover 30 is connected to the battery compartment 203, the second set of securing structures of the eyepiece end cover 50, and more specifically, the lip 51 is pushed into the sleeve 33*a* of the objective end cover 30. The first set of securing structures 35 of the objective end cover 30 engages or snaps over the lip 51 of the second set of securing structures of the eyepiece end cover 50 so as to sit in the gap 52 to secure the objective end cover 30 to the eyepiece end cover 50. Specifically, pushing the lip 51 into the sleeve 33*a* results in the lip 51 being secured in the sleeve 33*a* of the cap 30 with the first set of securing structures 35 around the gap 52. The circumferential projections 31*a*, 31*b* prevent the sleeve 33*a* from disengaging the cover 50 by simply moving the sight 200 or with inadvertent touching. Some force will be necessary to disengage the covers 30, 50 from one another. The wall 38 prevents the cover 50 from being pushed further into the objective end cover 30.

While in the embodiments described herein, the cover 30, 50 are each described such that the objective end cover 30 is configured to secure to the sight body 220 and the eyepiece end cover 50 includes a second set of securing structures configured to secure to the first set of securing structures 35 of the objective end cover 30, it will be appreciated that in further embodiments, the eyepiece end cover 50 may be configured to secure to the sight body 220 and/or the two covers 30, 50 may be configured to secure to one another in a different orientation.

In the embodiments shown, the protective lens cover assembly 100 is used in combination with a sight 200 that is shown apart from any firearm. It will be appreciated that the protective lens cover assembly 100 may be used with sights that can be affixed to and/or used with a variety of firearms. As used herein, a "firearm" is a portable gun, being a barreled weapon that launches one or more projectiles often driven by the action of an explosive force. As used herein, the term "firearm" includes a handgun, a long gun, a rifle, a shotgun, a carbine, automatic weapons, semi-automatic weapons, a machine gun, a sub-machine gun, an automatic rifle and an assault rifle.

Various modifications and variations of the described assemblies and methods of the invention will be apparent to those skilled in the art without departing from the scope and spirit of the invention. One skilled in the art will recognize at once that it would be possible to construct the present invention from a variety of materials and in a variety of different ways. Although the invention has been described in connection with specific preferred embodiments, it should be understood that the invention should not be unduly limited to such specific embodiments. While the preferred embodiments have been described in detail, and shown in the accompanying drawings, it will be evident that various further modification are possible without departing from the scope of the invention as set forth in the appended claims. Indeed, various modifications of the described modes for carrying out the invention which are obvious to those skilled in marksmanship or related fields are intended to be within the scope of the following claims.

What is claimed is:

1. A protective lens cover assembly comprising:

a body;

a first lens cover having a first set of securing structures and a second set of securing structures, wherein the first lens cover comprises a first sleeve and a second sleeve, the first and second sleeve separated by a wall, and wherein the first set of securing structures is on the first sleeve and the second set of securing structures is on the second sleeve; and a second lens cover having a first set of securing structures and a second set of securing structures;

wherein the first lens cover and second lens cover are connected to the body, wherein the first set of securing structures of one of the first lens cover and second lens cover is configured to engage the second set of securing structures of the other of the first lens cover and second lens cover.

2. The protective lens cover assembly of claim 1, wherein the first and second sets of securing structures of the first lens cover are identical or substantially identical.

3. The protective lens cover assembly of claim 1, wherein the first and second sets of securing structures each comprise a groove along the circumference of the inside of the sleeve and two circumferential projections, wherein a first of the circumferential projections is on a first side of the groove and a second of the circumferential projections is on a second side of the groove.

4. The protective lens cover assembly of claim 1, wherein the second lens cover comprises a first sleeve and a wall, wherein the first set of securing structures is on the first sleeve and the second set of securing structures is on the wall.

5. The protective lens cover assembly of claim 4, wherein the first set of securing structures comprises a groove along the circumference of the inside of the sleeve and two circumferential projections, wherein a first of the circumferential projections is on a first side of the groove and a second of the circumferential projections is on a second side of the groove.

6. The protective lens cover assembly of claim 4, wherein the second set of securing structures comprises a lip.

7. A sight comprising:

a sight body with an objective end having a lens and an eyepiece end having a lens; and a protective lens cover assembly connected to the sight body, the assembly comprising a body;

a first lens cover having a first set of securing structures and a second set of securing structures, wherein the first lens cover comprises a first sleeve and a second sleeve, the first and second sleeve separated by a wall, and wherein the first set of securing structures is on the first sleeve and the second set of securing structures is on the second sleeve; and a second lens cover having a first set of securing structures and a second set of securing structures;

wherein the first lens cover and second lens cover are connected to the body, wherein the first set of securing structures of the first lens cover engages the objective end of the sight body, the first set of securing structures of the second lens cover engages the eyepiece end of the side body, the second set of securing structures of at least one of the first lens cover and second lens cover engages the sight body, and the second set of securing structures of the other of the first lens cover and second lens cover engages first securing structures of the at least one of the first lens cover and second lens cover.

8. The sight of claim 7, wherein the second set of securing structures of the first lens cover engages the sight body and the second set of securing structures of the second lens cover engages the first set of securing structures of the first lens cover.

9. The sight of claim 7, wherein the sight body further includes a battery compartment.

10. The sight of claim 9, wherein the second set of securing structure of the at least one of the first lens cover and the second lens cover engages the battery compartment.

11. The sight of claim 10, wherein the body of the protective lens cover assembly is connected to the battery compartment.

12. The sight of claim 11, wherein the first and second sets of securing structures of the first lens cover are identical.

13. The sight of claim 7, wherein the sight is connected to a firearm.

* * * * *